US005791493A

United States Patent [19]

Meyer

[11] Patent Number: 5,791,493

[45] Date of Patent: Aug. 11, 1998

[54] POLYSILICON PARTICLE CLASSIFYING APPARATUS

[75] Inventor: James R. Meyer, Baton Rouge, La.

[73] Assignee: MEMC Electronic Materials, Inc., St. Peters, Mo.

[21] Appl. No.: 686,570

[22] Filed: Jul. 26, 1996

[51] Int. Cl.[6] ..... B07B 1/28

[52] U.S. Cl. ..... 209/245; 209/248; 209/682; 209/683

[58] Field of Search ..... 209/243, 244, 209/245, 247, 248, 680, 682, 683, 707

[56] References Cited

U.S. PATENT DOCUMENTS

| | | | |
|---|---|---|---|
| 67,130 | 7/1867 | Merrill . | |
| 161,840 | 4/1875 | Thomas . | |
| 494,395 | 3/1893 | Thomas . | |
| 579,583 | 3/1897 | Jermyn . | |
| 1,056,764 | 3/1913 | Naramor . | |
| 1,309,401 | 7/1919 | Fogelsonger . | |
| 1,634,192 | 6/1927 | Hovda . | |
| 1,648,716 | 11/1927 | Berrisford . | |
| 3,565,248 | 2/1971 | Messerschmidt | 209/73 |
| 3,899,416 | 8/1975 | Schwartz et al. | 209/118 |
| 3,990,580 | 11/1976 | Self | 209/682 X |
| 4,379,748 | 4/1983 | Hoogendoorn | 209/11 |
| 4,857,173 | 8/1989 | Belk | 209/2 |
| 5,211,291 | 5/1993 | Kelley et al. | 209/680 |

FOREIGN PATENT DOCUMENTS

| | | | |
|---|---|---|---|
| 3319032C2 | 4/1986 | Germany . | |
| 426717 | 1/1975 | U.S.S.R. . | |
| 682284 | 8/1979 | U.S.S.R. . | |
| 1475729 | 4/1989 | U.S.S.R. | 209/682 |

*Primary Examiner*—William E. Terrell
*Assistant Examiner*—Tuan N. Nguyen
*Attorney, Agent, or Firm*—Senniger, Powers, Leavitt & Roedel

[57] ABSTRACT

Apparatus for classifying high purity polysilicon particles includes a receptacle for holding the particles and a rotary member for feeding the particles from the receptacle. The rotary member defines at least a portion of a front wall of the receptacle and is supported for rotation about its generally horizontally oriented longitudinal axis. A motor drives rotation of the rotary member such that a longitudinal groove passes through the receptacle to pick up particles smaller than a predetermined size and dump the captured particles onto an inclined surface disposed generally forward of the receptacle. The particles slide downwardly acquiring a velocity according to their shape. A gap between a lower edge of the inclined surface and a first receiver is sized such that only particles having more than a predetermined velocity are capable of traversing the gap to the first receiver. The remaining particles fall through the gap and into a second receiver. The receptacle, inclined surface member and first receiver are constructed with contamination inhibiting material to inhibit contamination of the particles.

14 Claims, 5 Drawing Sheets

POLYSILICON PARTICLE CLASSIFYING APPARATUS

BACKGROUND OF THE INVENTION

This invention relates generally to particle classifying apparatus, and in particular to apparatus for classifying high purity polysilicon particles.

Conventional production of polysilicon particles consists of introducing fine particles, or seeds, into a fluid bed reactor where the seeds grow into larger, spherically shaped particles. The particles are released from the reactor and directed into a quartz lined particle cooler for cooling the particles. The particles are later used to produce semiconductor materials by melting down the particles and growing a monosilicon crystalline ingot. Throughout the particle production process and semiconductor material production process, the particles flow through a number of conduits and valves.

While the polysilicon particles produced by this process are typically spherical, irregularly shaped particles occasionally enter the mixture of particles flowing through the conduits and valves. For example, multiple polysilicon particles may bind together while in the reactor, or polysilicon particle dust, otherwise known as "fines" may adhere to the larger particles as the particles are removed from the reactor. Additionally, irregularly shaped contaminates, such as quartz shards or fragments, may break loose from the quartz lined particle cooler and enter the flow of particles. The irregularly shaped particles do not flow through the conduits and valves as efficiently as the spherical particles, and may cause clogging of the conduits and valves and inhibit the flow of particles. The production process may also result in particles which are too large to flow through the conduits and valves. The fines are also not useful for producing semiconductor materials because they tend to vaporize before they can be melted. Thus, it is desirable to classify the particles according to shape and size in order to separate the spherical particles of desired size from the irregularly shaped particles, excessively large particles and fines.

Conventional classifying apparatus for classifying polysilicon particles typically separate the particles by weight, such as, for example, heavy, intermediate and fines. The classifying apparatus of this type, as disclosed in U.S. Pat. No. 4,857,173 (Belk) comprises a vertically extending tube through which an inert gas flows upward from the bottom of the tube to the top of the tube at a predetermined velocity. A particle mixture is introduced into the tube and the particles are carried upward through the tube by the inert gas flow. The predetermined velocity of the gas is such that the heavy particles cannot be carried upward and immediately fall to the bottom of the tube. At an upper point along the tube, the diameter of the tube expands, causing the velocity to decrease to a level which can no longer carry the intermediate particles. The intermediate particles thus fall back down into containers surrounding the side of the tube. The fines are carried by the gas flow to the top of the tube and into a container. However, the conventional apparatus described above separates particles based on the weight, or density, of the particles rather than the shape of the particles. This type of classifying apparatus is thus unsuitable for separating, for example, spherical particles from irregularly shaped particles.

SUMMARY OF THE INVENTION

Among the several objects of this invention may be noted the provision of an improved classifying apparatus for classifying high purity polysilicon particles; the provision of such a classifying apparatus which can accurately classify particles according to shape; the provision of such a classifying apparatus which will not become clogged with polysilicon particles; the provision of such a classifying apparatus which feeds particles to be classified in a controlled, uniform manner; the provision of such a classifying apparatus which reduces the risk of contamination of the particles classified by the apparatus; and the provision of such a classifying apparatus which is economical and easy to use.

In general, classifying apparatus of the present invention for classifying high purity polysilicon particles used in production of semiconductor material comprises a receptacle sized and shaped for holding a volume of the polysilicon particles. The receptacle is at least partially constructed of contamination inhibiting material disposed for contacting the particles held by the receptacle thereby to inhibit contamination of the particles. The receptacle includes a front wall and a back wall opposite the front wall. A particle feeder defines at least a portion of the front wall and comprises a rotary member supported for rotation about its generally horizontally oriented longitudinal axis. The rotary member projects into the receptacle and is in closely spaced relation therewith for inhibiting the passage of particles between the rotary member and the receptacle such that the rotary member is positioned to hold the volume of particles in the receptacle from pouring out of the receptacle. The rotary member has an outer surface and a longitudinally extending groove in the outer surface. A motor is operatively connected to the rotary member for selectively driving rotation of the rotary member about its longitudinal axis such that the longitudinal groove passes through the particles in the receptacle. The groove is sized to capture particles of a predetermined size or smaller and to reject particles of a size larger than the predetermined size. The groove carrying the captured particles continues generally forwardly and upwardly out of the receptacle, thereafter dumping the captured particles and returning into the receptacle. Inclined surface means is disposed generally forward of the receptacle and slopes downwardly away from the receptacle. The inclined surface means is disposed for receiving particles dumped from the longitudinal groove of the rotary member, and is made at least in part from contamination inhibiting material on which the particles are received and travel downwardly acquiring a velocity according to their shape. First and second receiver means are located at least partially forward of a lower edge of the inclined surface member. The first receiver means is formed at least in part from contamination inhibiting material. A gap is defined between the lower edge of the inclined surface means and the first receiver means and is sized such that only particles having more than a predetermined velocity are capable of traversing the gap to the first receiver means. The remaining particles fall through the gap and into the second receiver means.

Other objects and features will be in part apparent and in part pointed out hereinafter.

BRIEF DESCRIPTION OF THE DRAWINGS

Corresponding parts are indicated by corresponding reference numerals throughout the several views of the drawings.

DETAILED DESCRIPTION OF THE PREFERRED EMBODIMENTS

Figure 1:
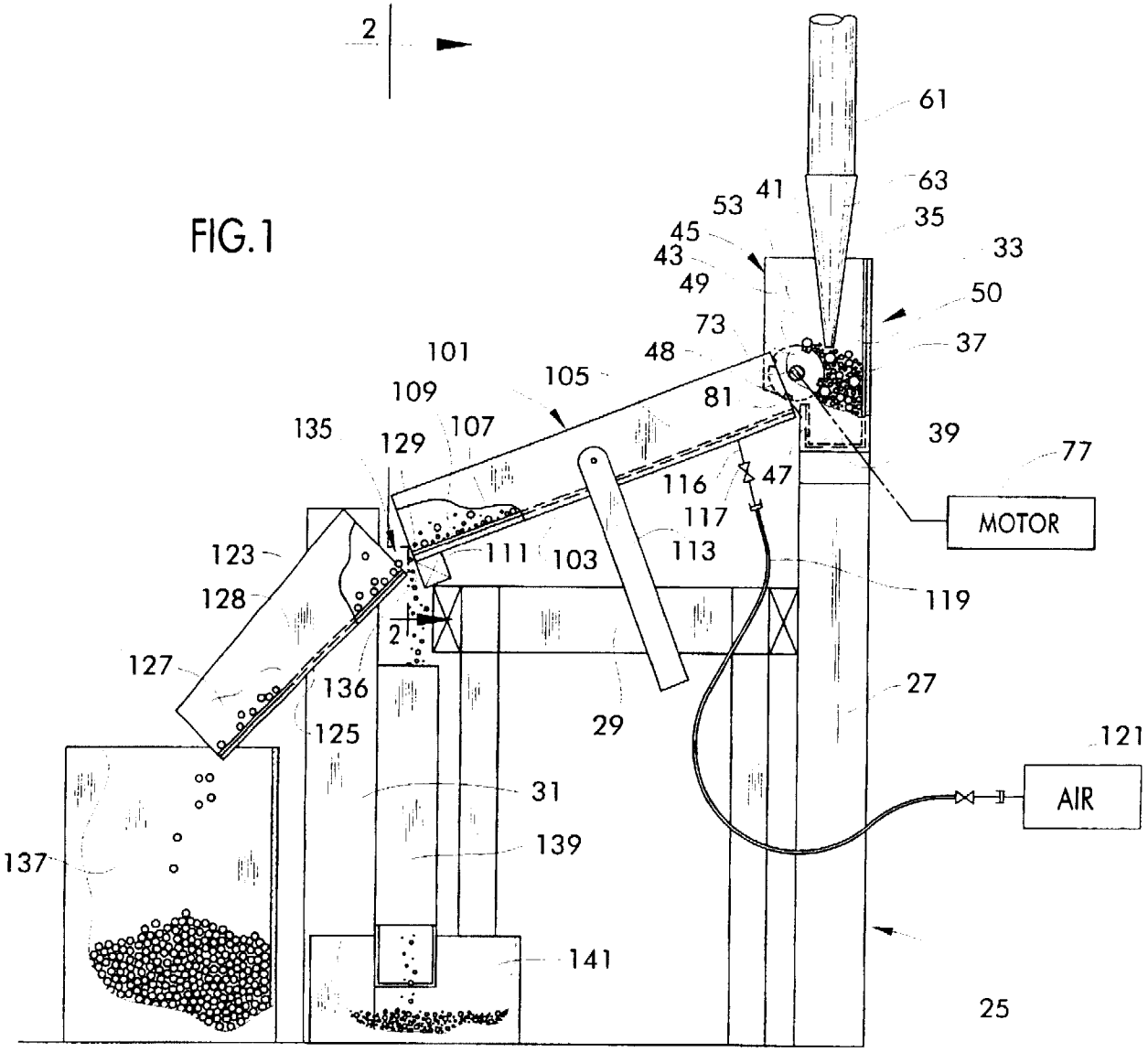
FIG. 1 is a schematic elevation of a classifying apparatus of a first embodiment of this invention with parts broken away to illustrate the travel of particles being classified.
Figure 2:
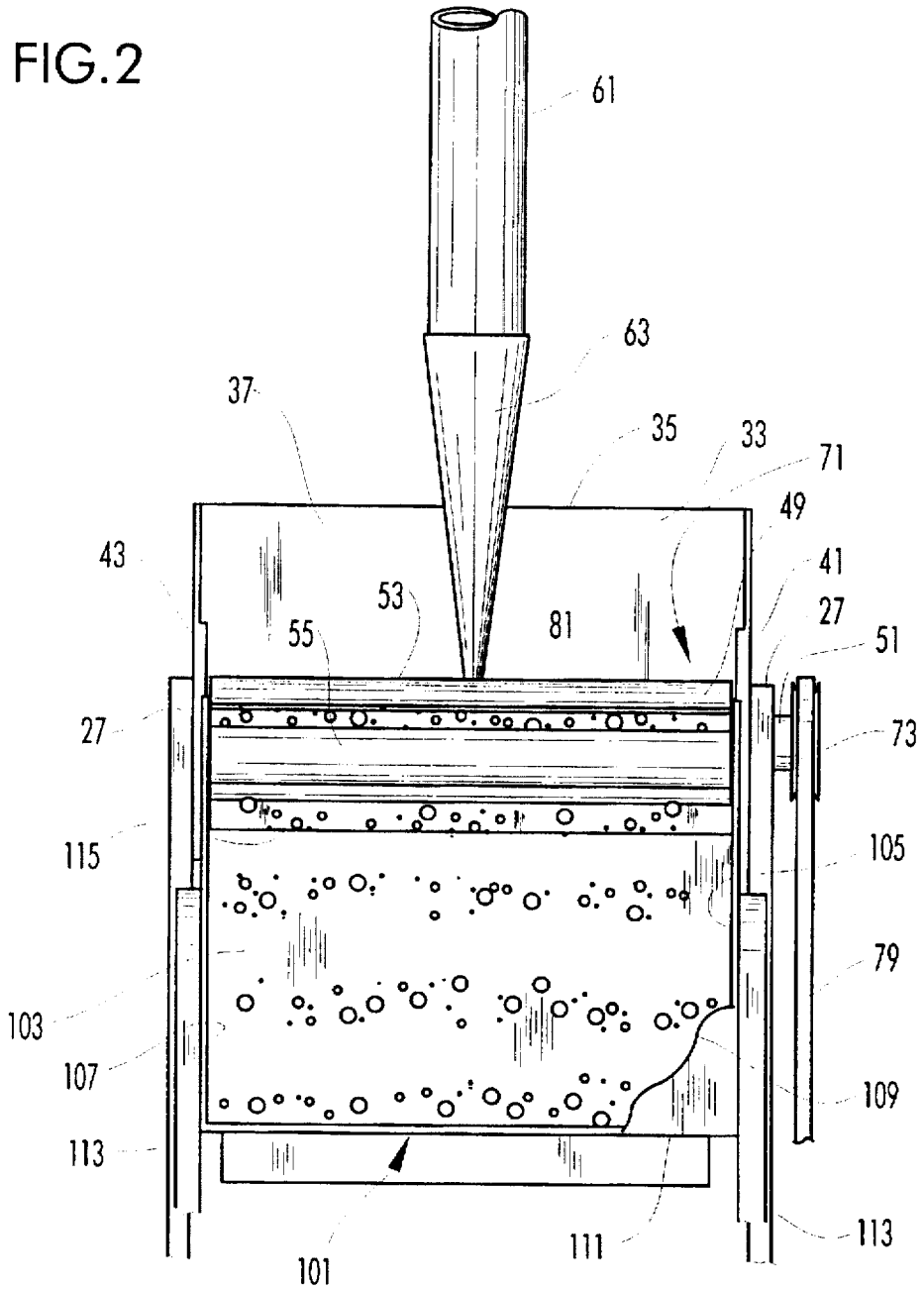
FIG. 2 is a fragmentary left side view of a section of the classifying apparatus of FIG. 1 as seen from the vantage indicated by line 2—2 in FIG. 1.

Now referring to the drawings, and particularly to FIGS. 1 and 2, the reference numeral 21 generally indicates a particle classifying apparatus of this invention for classifying high purity polysilicon particles. The particles, which vary in size and shape, are received by the classifying apparatus 21 from a source of polysilicon particles, such as a reactor (not shown). While the particles are typically spherical, some of the particles may be irregularly shaped. Additionally, the particles may range in size from fine to oversized. For use in particular applications, such as producing semiconductor materials, it is desirable to have high purity polysilicon particles which are generally spherical in shape and of a certain size. Thus, the particle classification apparatus 21 is used to separate the desired spherical particles from the oversized, fine and irregular particles.

The particle classifying apparatus 21 is supported by a frame, indicated generally at 25. The frame 25 comprises a receptacle stand 27, a slide support 29, and a chute support 31. The receptacle stand 27 and supports 29, 31 may be connected, as by fastening or welding, or be integrally formed, to increase the stability of the frame 23. A receptacle, generally indicated at 33 for holding the polysilicon particles is mounted on top of the receptacle stand 27. The receptacle 33, which has an open top 35 for receiving the polysilicon particles, comprises a rear wall 37, bottom wall 39, side walls 41, 43 and front wall, generally indicated at 45. The walls 37, 39, 41, 43, 45 of the receptacle are preferably constructed of stainless steel lined with a contamination inhibiting material 50 such as quartz, silicon, or other material having similar contamination inhibiting properties. The contamination inhibiting material 50 inhibits foreign particles or fragments from the underlying steel structure, which are undesirable for semiconductor production, from being mixed in with the particles and contaminating their purity. The front wall 45 of the receptacle 33 extends upward from the bottom wall 39, terminating at a location below the top 35 of the receptacle. Thus, the front of the receptacle 33 is partially open for passage of polysilicon particles out of the receptacle.

The front wall 45 comprises a fixed lower portion 47 exteding upward from the bottom wall 39 of the receptacle 33, and a particle feeder (indicated generally at 48) including a cylinder 49 rotatably mounted on a shaft 51 extending laterally between forwardly extending portions of the side walls 41, 43. The cylinder 49 extends substantially the entire distance between the side walls 41, 43 above the fixed lower portion 47 of the front wall 45 in closely spaced relation with the lower portion to prevent particles within the receptacle 33 from falling out of the receptacle between the cylinder and the fixed lower portion of the front wall. A portion of the outer surface of the cylinder 49 which is at a vertically uppermost position 53 at any given time defines the top of the front wall 45. Arranged in this manner, the rear wall 37, bottom wall 39, side walls 41, 43, and the fixed lower portion 47 and cylinder 49 of the front wall 45 define a well within the receptacle 33 for retaining the polysilicon particles. It is contemplated that the front wall 45 may comprise only the cylinder 49 extending above the bottom wall 39 of the receptacle 33 in closely spaced relation therewith and remain within the scope of this invention.

A particle delivery conduit 61 leading from the source of polysilicon particles carries a mixture of the polysilicon particles to the receptacle 33. The conduit 61 extends downward through the open top 35 of the receptacle 33, to direct the particles into the receptacle well between the front wall 45 and the rear wall 37. A cone shaped dropper portion 63 of the conduit 61 has an opening at its lower end which is smaller than the diameter of other portions of the conduit to control the rate at which particles are dropped into the receptacle 33. As shown in FIGS. 1 and 2, the lower end of the dropper is preferably disposed slightly lower than a horizontal plane tangent to the portion of the outer surface of the cylinder 49 which is at the vertically uppermost position 53 so that the particles will block the dropper opening and prevent further particles from being received by the receptacle in the event the well becomes filled with particles to prevent an overflow of particles from the receptacle 33.

Figures 3, 6:
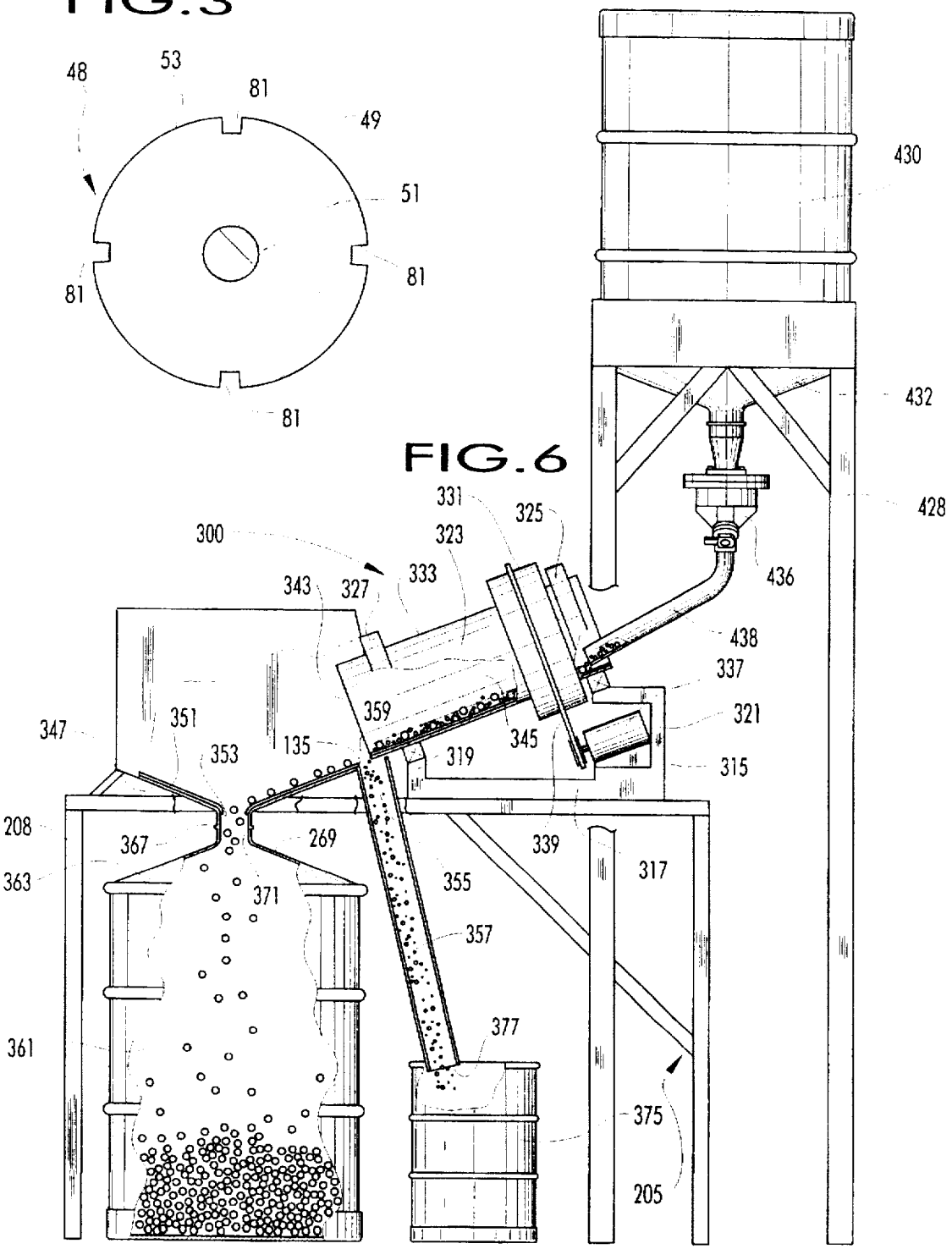
FIG. 3 is a cross-section of a particle feeder of the apparatus.
FIG. 6 is a schematic elevation of a third embodiment of the classifying apparatus of this invention.

The particle feeder 48 transfers particles out of the receptacle 33 while performing a first classifying operation. The particle feeder 48 comprises the cylinder 49, which extends into the receptacle 33, and the shaft 51 on which the cylinder is rotatably mounted. Opposing ends 73 (only one side shown) of the shaft 51 extend through the respective side walls 41, 43 of the receptacle. One end 73 of the shaft 51 is operatively connected to a motor 77 by a drive belt 79 (FIG. 2) to provide a means for rotating the shaft and cylinder 49. Grooves 81 extend longitudinally within the outer surface 55 of the cylinder 49 and are sized and shaped to capture polysilicon particles of a predetermined size or smaller. As shown in FIG. 3, the preferred cylinder 49 has four grooves 81 spaced at ninety degree intervals about the circumference of the cylinder, each groove measuring approximately 0.25 inches wide and 0.25 inches deep. It is understood, however, that the cylinder 49 may comprise any number of grooves 81 at various circumferential spacing and that the grooves may be of various dimensions without departing from the scope of this invention. The grooves 81 preferably extend substantially the entire length of the cylinder 49. Rotation of the cylinder 49 allows the outer surface of the cylinder to continually rotate through the receptacle 33 such that particles of a predetermined size and smaller are captured and retained in the grooves 81 within the cylinder. Particles which are larger than the predetermined size remain in the receptacle 33 until they are later removed. The grooves 81 thus provide an efficient first classifying operation by separating out the oversized particles. The cylinder 49 continues to rotate in a direction which carries the captured polysilicon particles upward and forward over the top of the cylinder. As the grooves 81 are further rotated forward and downward out of the receptacle 33, the captured particles are dumped from the grooves.

Referring again to FIG. 1, a slide, indicated generally at 101, is supported by the slide support 29 in an inclined orientation extending forward and downward away from the receptacle 33. The slide 101 comprises a generally planar ramp 103 and side walls 105, 107 extending upward from laterally opposite edges of the ramp. As best seen in FIG. 2, the slide 101, which is preferably constructed of stainless steel, is lined with sheets of contamination inhibiting material 109 to inhibit foreign particles or fragments of the underlying steel structure from becoming entrained in the flow of particles and contaminating the purity of the polysilicon particles. A lower end of the slide 101 rests on a bearing 111 on the slide support 29 while the remainder of the slide is supported at a predetermined inclination by support rods 113 extending between the slide support and the slide. The lower end of the slide 101 and bearing 111 is pivotally connected to the slide support 29, such as by hinged connection (not shown). The support rods 113 are releasably secured to the slide support 29 using a ratchet and pawl type connection (broadly, "angle adjusting means") to secure the slide 101 at a predetermined inclination. In this manner, the inclination of the slide 101 is adjustable by repositioning the rods 113 to pivot the slide about its lower end to change the angle of inclination of the slide. For example, the angle of inclination of the slide 101 relative to the slide support 29 embodied in FIG. 1 is preferably 21 degrees, while the adjustable range of inclination angles is about 15 to 45 degrees. It is understood that other suitable structure for releasably securing the support rods 113 to the slide support 29 to form the angle adjusting means is contemplated to be within the scope of this invention. Additionally, it is contemplated that the support rods 113 may be power driven, as by a hydraulic or motor driven actuator (not shown).

The upper end of the slide 101 is disposed below the cylinder 49 of the particle feeder 48 to receive the polysilicon particles dumped from the grooves 81 of the cylinder. The inclination of the slide 101 urges the particles to travel forward and downward so that the particles increase in velocity as they approach the lower end of the slide. As shown in FIG. 2, the longitudinally extending grooves 81 of the cylinder 49 dump the particles across the width of the planar surface of the slide 101 in a uniform thin layer. This reduces interference between particles, thereby providing an uninhibited path for travelling down the slide 101. Particles which are generally spherical will tend to roll down the slide 101 and have a greater end velocity than irregularly shaped particles which slide along the planar ramp 103 of the slide and incur greater resistance to travel due to friction between the particle and the slide. The particles will thus have varying velocities upon reaching the lower end 111 of the slide 101, depending on the shape and size of each particle.

Irregularly shaped particles and fines may stagnate on the slide 101, due, for example, to the friction between the particles and the slide, thereby damming the slide and blocking or inhibiting the downward travel of other particles. A vibrator 116 is mounted on the slide 101, preferably beneath the planar ramp 103, and includes a needle valve 117 connected by an air hose 119 to a source of compressed air 121 to impart vibratory impulses to the planar ramp of the slide. Vibration of the planar ramp 103 inhibits particles from stagnating on the slide 101 and encourages the particles to continue travelling down toward the lower end 111 of the slide. It is contemplated that other conventional means for effecting vibration of the planar ramp 103 of the slide 101, such as an electric variable speed vibrating device, may be used and remain within the scope of this invention.

A first chute 123 comprising a ramp 125 and side walls 127, 128 extending upward from the ramp is mounted on the chute support 31 forward of a lower edge 129 of the slide 101. The first chute 123 inclines forward and downward away from the slide 101 and is spaced apart from the slide to define a gap 135 between the lower edge 129 of the slide and an upper edge 136 of the chute ramp 125. Since the upper edge 136 of the first chute 123 is lower than the lower edge 129 of the slide 101, the gap 135 between the slide and chute provides an efficient means for performing a second classifying operation. By way of example, the preferred gap 135 of FIG. 1 measures 1.00 inch horizontally and 1.00 in vertically. It is understood, however, that the size of the gap 135 will vary depending on the acceptable range of particle sizes and shapes. Upon reaching the lower end 111 of the slide 101, those particles having a predetermined velocity or greater, corresponding to a predetermined range of shapes, will traverse the gap 135 and be received by the first chute 123. The width of the first chute 123 narrows toward its lower end so that particles successfully traversing the gap 135 travel down the chute and are funnelled into an open container 137 disposed below the chute. The remaining particles fail to traverse the gap 135 and fall through the gap into a second chute 139 disposed below the gap. The second chute 139 of the preferred embodiment is mounted on the chute support 31 and extends transversely below the gap 135 to receive the particles. The second chute 139 is inclined to direct the remaining particles into a second container 141 below the second chute.

Figure 4:
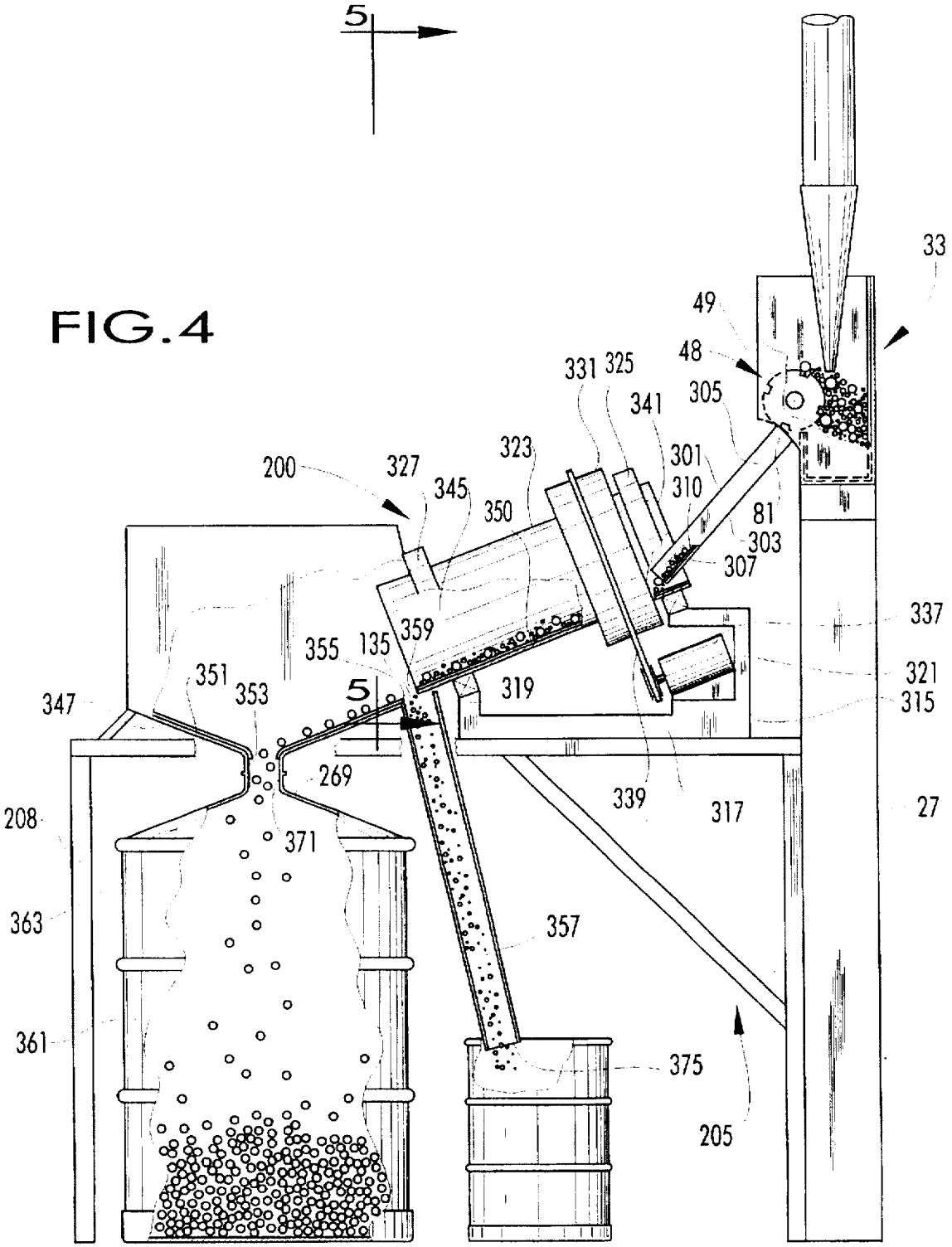
FIG. 4 is a schematic elevation of a second embodiment of the classifying apparatus of this invention.
Figure 5:
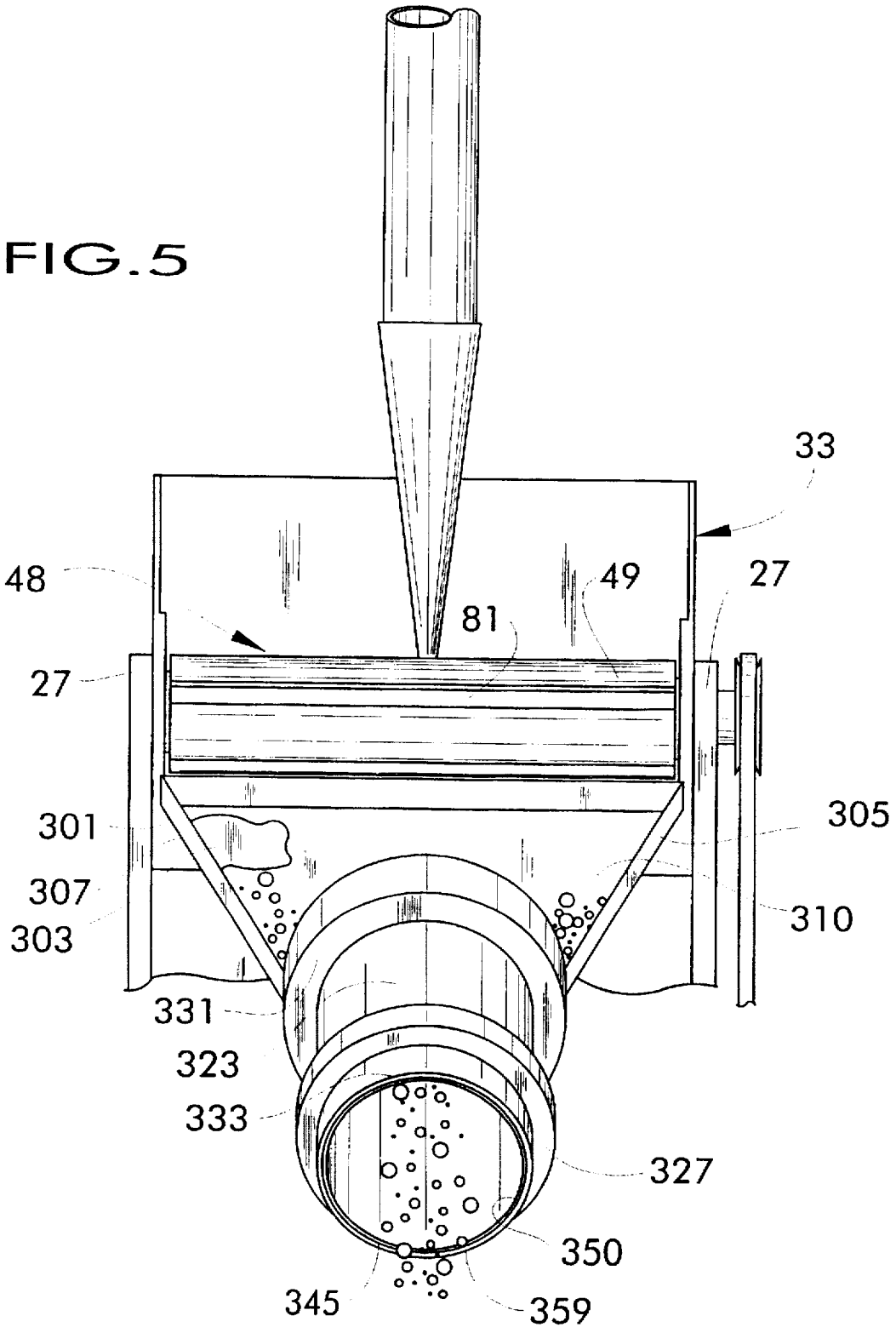
FIG. 5 is a fragmentary left side view of a section of the second embodiment as seen from the vantage indicated by line 5—5 in FIG. 4.

FIGS. 4 and 5 illustrate a classifying apparatus 200 of a second embodiment of this invention. The same reference numbers will be used to designate corresponding parts of the first and second embodiments. In this embodiment, a frame, indicated generally at 205, comprises the receptacle stand 27 of the first embodiment and a classifier stand 208. The receptacle 33 and particle feeder 48 are mounted on the receptacle stand 27 in the same manner and have the same elements as described in the embodiment of FIGS. 1 and 2. A funnelling chute 301 is attached to the receptacle 33 and inclines forward and downward away from the receptacle. The funnelling chute 301, having a ramp 303 and side walls 305, 307 extending upward from opposing sides of the ramp, is preferably constructed of stainless steel lined with contamination inhibiting material 310. The upper end of the funnelling chute 301 is disposed below the cylinder 49 of the particle feeder 48 to receive the polysilicon particles dumped from the grooves 81 of the cylinder. The inclination of the funnelling chute 301 is sufficiently steep to prevent irregularly shaped particles from stagnating on the chute. The width of the ramp 303 of the funnelling chute 301 narrows toward the lower end of the chute such that particles travelling forward and downward on the chute are funneled together somewhat as they reach the lower end of the chute.

A tube support 315 seated on top of the classifier stand 208 comprises a bottom support member 317, a forward support member 319 and a rear support member 321. The forward 319 and rear 321 support members extend upward from the bottom support member 317, with the rear support member extending substantially higher than the forward support member. The forward 319 and rear 321 support members support a rotating tube 323 in a predetermined inclined orientation extending forward and downward away from the lower end of the funnelling chute 301. Together, the tube 323 and funnelling chute 301 constitute inclined surface means in the second embodiment. As an example, the preferred angle of inclination of the rotating tube 323 embodied in FIG. 5 is 21 degrees. Because of the small size of the polysilicon particles, the rotating tube 323 may be short in length, such as, for example, 24 inches. It is understood, however, that the angle of inclination and length of the tube 323 may vary without departing from the scope of this invention. A pair of annular bearings (an upper bearing 325 and a lower bearing 327) are mounted on the rear 321 and forward 319 support members, respectively, and encircle the tube 323 such that the tube may rotate about its central longitudinal axis. A drive ring 331 is integrally formed with the tube 323. A motor 337 attached to the bottom support member 317 and connected to the drive ring 331 by a belt 339 drivingly rotates the tube 323. It is contemplated that the tube 323 may be rotated by other means, such as by interlocking gears or friction wheels, and remain within the scope of this invention.

The rotating tube 323 is preferably constructed of stainless steel and has an inner surface 345 lined with contamination inhibiting material 350 to inhibit foreign particles or fragments of the underlying tube structure from adhering to and contaminating the purity of the polysilicon particles. The lower end of the funnelling chute 301 extends into the upper end of the tube 323 so that polysilicon particles falling from the lower end of the funnelling chute drop onto the inner surface 345 of the tube. The inclination of the tube 323 encourages the particles to travel forward and downward, increasing in velocity as they approach the lower end of the tube. Particles which are generally spherical will tend to roll down the inner surface 345 of the tube 323 and have a greater end velocity than irregularly shaped particles which slide along the inner surface of the tube and incur greater resistance to travel due to friction between the particle and the tube. The particles will thus have varying velocities upon reaching the lower end of the tube 323, depending on the shape of each particle.

The irregularly shaped particles and fines could stagnate on the inner surface 345 of the tube 323, due, for example, to the friction between the particles and the inner surface of the tube, thereby damming the tube and blocking or inhibiting the downward travel of other particles. To prevent stagnation of the particles, the rotating tube 323 carries the stagnant particles outward and upward on the inner surface 345 of the tube until gravity causes the particles to fall back down into the flow of particles travelling down through the tube. In this way, uninhibited flow of particles through the tube is maintained without vibration.

A funnel 347 having a bottom wall 351 sloping toward a central opening 353 is supported by the classifier stand 208 forward of the rotating tube 323. The bottom wall 351 of the funnel extends downward through the classifier support 208. A peripheral opening 355 in the bottom wall 351 of the funnel 347 is disposed adjacent the lower end of the tube 323. The peripheral opening 355 defines the inlet of a duct 357 extending downward from the funnel 347. The lower end of the tube 323 extends partially over the peripheral opening 355 in the bottom wall 351 of the funnel 347 to define the gap 135 between a lower edge 359 of the tube and the bottom wall of the funnel. By way of example, the gap 135 of the embodiment shown in FIG. 5 measures one inch horizontally and one inch vertically. It is understood, however, that the dimensions of the gap 135 may vary without departing from the scope of this invention. Arranged in this manner, the gap 135 between the lower edge 359 of the tube 323 and the bottom wall 351 of the funnel 347 provides an efficient means for performing a second classifying operation of the polysilicon particles. As the particles reach the lower edge 359 of the tube 323, particles having a predetermined velocity or greater will traverse the gap 135 and land on the bottom wall 351 of the funnel 347. As shown in FIG. 5, the funnel 347 is enclosed to prevent particles from exiting the funnel by means other than through the central opening 353 or the peripheral opening 355.

The funnel 347 directs particles successfully traversing the gap 135 into the central opening 353 in the funnel and into a first container 361 disposed below the funnel. The first container 361 includes an inverted-funnel shaped lid 363 which is connected to the top of the container and an integrally formed flange 367 extending upward from a top 369 of the lid and having an opening 371 corresponding in size to the central opening 353 in the bottom wall 351 of the funnel 347. The flange 367 is coaxial with the central opening 353 of the funnel 347 and a connector (not shown) releasably joins the funnel and the first container 361 to provide communication between the funnel and the container. It is also contemplated that the size of the flange opening 371 may be larger than the central opening 353 of the funnel 347 so that the funnel seats into the flange opening to interconnect the funnel and container 361. Together, the funnel 347 and first container 361 constitute "first receiver means" in the second embodiment.

The remaining particles will fail to traverse the gap 135 between the lower edge 359 of the tube 323 and the bottom wall 351 of the funnel 347 and will fall through the gap, through the peripheral opening 355 in the funnel and into the duct 357. The duct 357 directs the remaining particles into a second container 375 disposed below an outlet 377 of the duct 357. Together, the duct 357 and second container 375 constitute "second receiver means" in the second embodiment.

FIG. 6 illustrates a classifying apparatus 300 of a third embodiment similar to the classifying apparatus 200 of FIGS. 4 and 5 in which the receptacle stand 27 is replaced with a feeder stand 428 for supporting a drum 430 having a funnel shaped bottom 432. The same reference numbers will be used to designate corresponding parts of the second and third embodiments. The drum 430 contains polysilicon particles that are funneled by gravity through the funnel shaped bottom 432 of the drum. A feeder valve 436 is connected to the funnel shaped bottom 432 of the drum 430 for receiving the particles. The valve 436 provides an operator with a means for adjusting the rate at which the particles flow out of the drum 430. A conduit 438 leading from the feeder valve 436 is lined with contamination inhibiting material. The conduit 438 extends into the upper end of the rotating tube 323 so that particles exiting the conduit will fall onto the inner surface 345 of the tube. The remainder of the classifying apparatus is the same as discussed for the second embodiment. Thus, classification of the particles received by the tube 323 then proceeds in a manner similar to that described in the embodiment of FIGS. 4 and 5.

It will be observed from the foregoing that the classifying characteristics provided by the classifying apparatus 21 of the present invention represent an improvement over conventional designs. Use of the particle feeder 48 as described above provides a first classifying operation before the particles are dropped onto the slide 101 or tube 323, and a dumping of the particles onto the slide in a uniform thin-layer to travel down the slide with little interference. This results in a more efficient and accurate separating of the polysilicon particles by shape. Also, the means for inhibiting stagnation of particles, such as the vibrator 116 of FIGS. 1–2 or the rotating tube 323 of FIGS. 4–6, further promote an uninhibited travel of the particles. Lining the various elements of the classifying apparatus of this invention with an contamination inhibiting material reduces the risk of contaminating the polysilicon particles with foreign fragments of non-polysilicon material. Additionally, using gravity to classify the particles results in reduced energy and cost over conventional gas based polysilicon particle separators.

The dimensions of the classifying apparatus, such as the length of the slide 101 or rotating tube 323, the diameter of the tube, the width and depth of the gap 135 over which the particles traverse, the width and depth of the grooves 81 in the cylinder 49 of the particle feeder 48, etc. will change depending on velocity requirements and acceptance/rejection criteria for the polysilicon particles.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for classifying high purity polysilicon particles used in production of semiconductor material, the apparatus comprising:

a particle feeder;

inclined surface means comprising a rotatable tube disposed for receiving particles dumped from the particle feeder, the rotatable tube sloping downwardly away from the particle feeder and being supported for rotation about its longitudinal axis, the rotatable tube being made at least in part from contamination inhibiting material on which the particles are received and travel downwardly acquiring a velocity according to their shape;

a motor operatively connected to the rotatable tube for selectively driving rotation of the tube about its longitudinal axis to inhibit the particles travelling downwardly through the tube from adhering thereto;

first and second receiver means located at least partially forward of a lower edge of the rotatable tube, said first receiver means being formed at least in part from contamination inhibiting material; and a gap defined between the lower edge of said rotatable tube and said first receiver means, the gap being sized such that only particles having more than a predetermined velocity traverse the gap to said first receiver means, the remaining particles falling through the gap and into said second receiver means.

2. Classifying apparatus as claimed in claim 1 wherein the contamination inhibiting material is selected from the group consisting of silicon, quartz, silicon carbide and silicon plasma coating.

3. Classifying apparatus as claimed in claim 1 further comprising:

a receptacle sized and shaped for holding a volume of the polysilicon particles, the receptacle being constructed at least partially of contamination inhibiting material disposed for contacting the particles held by the receptacle thereby to inhibit contamination of the particles, the receptacle including a front wall and a back wall opposite the front wall;

a particle feeder defining at least a portion of the front wall, the particle feeder comprising a rotary member supported for rotation about its generally horizontally oriented longitudinal axis, the rotary member projecting into the receptacle and being in closely spaced relation therewith for inhibiting the passage of particles between the rotary member and the receptacle such that the rotary member is positioned to hold the volume of particles in the receptacle from pouring out of the receptacle, the rotary member having an outer surface and a longitudinally extending groove in the outer surface;

a motor operatively connected to the rotary member for selectively driving rotation of the rotary member about its longitudinal axis such that the longitudinal groove passes through the particles in the receptacle, the groove being sized to capture particles of a predetermined size or smaller and to reject particles of a size larger than the predetermined size, the groove carrying the captured particles continuing generally forwardly and upwardly out of the receptacle, thereafter dumping the captured particles and returning into the receptacle.

4. Classifying apparatus as set forth in claim 3 wherein said inclined surface means further comprises a funneling chute disposed generally between the receptacle and the rotating tube for receiving the particles dumped from the longitudinal groove of the rotary member and funneling the particles into the rotating tube.

5. Apparatus for classifying high purity polysilicon particles used in production of semiconductor material, the apparatus comprising:

a receptacle sized and shaped for holding a volume of the polysilicon particles, the receptacle being constructed at least partially of contamination inhibiting material disposed for contacting the particles held by the receptacle thereby to inhibit contamination of the particles, the receptacle including a front wall and a back wall opposite the front wall;

a particle feeder comprising a rotary member supported for rotation about its generally horizontally oriented longitudinal axis, the rotary member projecting into the receptacle and having an outer surface and a longitudinally extending groove in the outer surface;

a motor operatively connected to the rotary member for selectively driving rotation of the rotary member about its longitudinal axis such that the longitudinal groove passes through the particles in the receptacle, the groove being sized to capture particles of a predetermined size or smaller and to reject particles of a size larger than the predetermined size, the groove carrying the captured particles out of the receptacle, thereafter dumping the captured particles;

inclined surface means disposed generally forward of the receptacle and sloping downwardly away from the receptacle, said inclined surface means being disposed for receiving particles dumped from the longitudinal groove of the rotary member, said inclined surface means being made at least in part from contamination inhibiting material on which the particles are received and travel downwardly acquiring a velocity according to their shape;

first and second receiver means located at least partially forward of a lower edge of the inclined surface member, said first receiver means being formed at least in part from contamination inhibiting material;

a gap defined between the lower edge of said inclined surface means and said first receiver means, the gap being sized such that only particles having more than a predetermined velocity traverse the gap to said first receiver means, the remaining particles falling through the gap and into said second receiver means.

6. Classifying apparatus as set forth in claim 5 wherein the rotary member is generally cylindrical in shape and has multiple circumferentially spaced, longitudinally extending grooves therein for picking up particles from the receptacle and depositing them on said inclined surface means.

7. Classifying apparatus as claimed in claim 6 wherein each of the grooves extends longitudinally along substantially the entire length of the rotary member.

8. Classifying apparatus as set forth in claim 7 further comprising a particle delivery conduit for delivering particles by gravity flow into the receptacle, the conduit including an open lower end from which particles exit the conduit into the receptacle, the lower end being positioned below a vertical plane tangent to the highest surface of the rotary member whereby particles filling the receptacle to a level approaching the vertical plane stop up the conduit to prevent further filling of the receptacle.

9. Classifying apparatus as claimed in claim 7 wherein the contamination inhibiting material is selected from the group consisting of silicon, quartz, silicon carbide and silicon plasma.

10. Classifying apparatus as claimed in claim 9 wherein said inclined surface means comprises means for inhibiting stagnation of particles travelling down said inclined surface means.

11. Classifying apparatus as claimed in claim 10 wherein said stagnation inhibiting means comprises an inclined rotatable tube supported for rotation about its longitudinal axis, and drive means for selectively driving rotation of the rotatable tube about its longitudinal axis to inhibit the particles travelling downwardly through the tube from adhering thereto, and wherein said inclined surface means further comprises a funneling chute disposed generally between the receptacle and the rotating tube for receiving the particles dumped from the longitudinal groove of the rotary member and funneling the particles into the rotating tube.

12. Classifying apparatus as claimed in claim 10 wherein said first receiver means comprises a first chute sloping downwardly away from said inclined surface means and disposed for receiving particles which traverse the gap, said chute being made at least in part from contamination inhibiting material on which the particles are received and travel downwardly toward a lower edge of the first chute, and a first container disposed below the lower edge of the first chute for receiving particles falling off the lower edge of said first chute.

13. Classifying apparatus as claimed in claim 12 wherein said second receiver means comprises a second chute sloping downwardly away from said inclined surface means and disposed below the gap for receiving particles which fall through the gap, said second chute being made at least in part from contamination inhibiting material on which the particles are received and travel downwardly toward a lower edge of the second chute, and a second container disposed below the lower edge of the second chute for receiving particles falling off the lower edge of the second chute.

14. Apparatus as set forth in claim 5 wherein the particle feeder defines at least a portion of the front wall and is disposed in closely spaced relation with the receptacle for inhibiting the passage of particles between the rotary member and the receptacle such that the rotary member is positioned to hold the volume of particles in the receptacle from pouring out of the receptacle.

* * * * *

UNITED STATES PATENT AND TRADEMARK OFFICE

CERTIFICATE OF CORRECTION

PATENT NO. : 5,791,493

DATED : August 11,1998

INVENTOR(S) : James R. Meyer

It is certified that error appears in the above-identified patent and that said Letters Patent is hereby corrected as shown below:

Please add the following claims:

Claim 15. Classifying apparatus as claimed in claim 10 wherein said inclined surface means comprises a planar slide.

Claim 16. Classifying apparatus as claimed in claim 15 further comprising an angle adjuster connected to the slide for selectively varying the inclination of said slide.

Claim 17. Classifying apparatus as claimed in claim 15 wherein said stagnation inhibiting means comprises a vibrator for vibrating the slide to inhibit particles travelling downwardly on the slide from adhering thereto.

UNITED STATES PATENT AND TRADEMARK OFFICE

CERTIFICATE OF CORRECTION

PATENT NO. : 5,791,493

DATED : August 11,1998

INVENTOR(S) : James R. Meyer

It is certified that error appears in the above-identified patent and that said Letters Patent is hereby corrected as shown below:

Claim 18. Classifying apparatus as set forth in claim 2 wherein the particle feeder comprises a conduit extending into an open upper end of the rotatable tube.

Claim 19. Classifying apparatus as set forth in claim 18 further comprising a receptacle for holding a quantity of particles to be classified, the conduit extending between the receptacle and the rotatable tube.

Signed and Sealed this

First Day of June, 1999

*Attest:*

Q. TODD DICKINSON

*Attesting Officer*

*Acting Commissioner of Patents and Trademarks*